US007878886B2

(12) United States Patent
Sun et al.

(10) Patent No.: US 7,878,886 B2
(45) Date of Patent: Feb. 1, 2011

(54) PNEUMATIC GRINDER WITH AN IMPROVED AIR INTAKE CONTROL APPARATUS

(75) Inventors: Yung-yung Sun, Dali (TW); Chuan-ching Cheng, Taichung (TW)

(73) Assignee: Storm Pneumtic Tool Co., Ltd., Taichung (TW)

( * ) Notice: Subject to any disclaimer, the term of this patent is extended or adjusted under 35 U.S.C. 154(b) by 0 days.

(21) Appl. No.: 11/896,463

(22) Filed: Aug. 31, 2007

(65) Prior Publication Data

US 2010/0255763 A1 Oct. 7, 2010

(51) Int. Cl.
*B24B 23/00* (2006.01)

(52) U.S. Cl. ..... 451/357; 451/359; 451/456

(58) Field of Classification Search ..... 451/294, 451/295, 344, 357, 359, 451, 456
See application file for complete search history.

(56) References Cited

U.S. PATENT DOCUMENTS 3,602,315 A * 8/1971 Tuttle ..... 173/1
4,631,012 A * 12/1986 Eckman ..... 418/70
5,993,305 A * 11/1999 Chu ..... 451/357
6,190,245 B1 * 2/2001 Heidelberger et al. ..... 451/357
6,752,705 B1 * 6/2004 Lin ..... 451/295
7,544,116 B1 * 6/2009 Lin ..... 451/294
2004/0058631 A1 * 3/2004 Lee ..... 451/295
2006/0057948 A1 * 3/2006 Lin ..... 451/359
2007/0141967 A1 * 6/2007 Kobayashi ..... 451/359
2009/0152319 A1 * 6/2009 Cain et al. ..... 227/130

* cited by examiner

*Primary Examiner*—Eileen P. Morgan
(74) *Attorney, Agent, or Firm*—Wang Law Firm; Li K. Wang

(57) ABSTRACT

In a pneumatic grinder with an improved air intake control apparatus, a press board is designed on the bottom of a handle of the grinder and disposed at a position proximate to a grinding head, and a force applying end of the press board is turned by fingers by means of a first lever-and-fulcrum pivoting method, so that a pulling end of the press board pulls a pull rod of the air intake control apparatus to move downward and allows air to circulate. The operation by fingers is easier than the operation by pressing a palm onto the top of a handle at the press board. A second lever design allows a speed adjusting knob of the air intake control apparatus to be situated at a position nearer to the grinding head.

9 Claims, 6 Drawing Sheets

PNEUMATIC GRINDER WITH AN IMPROVED AIR INTAKE CONTROL APPARATUS

BACKGROUND OF THE INVENTION

1. Field of the Invention

The present invention relates to a pneumatic grinder with an improved air intake control apparatus, and more particularly to a technology of controlling an air intake by turning a press board by fingers.

2. Description of the Related Art

Referring to FIG. 6 for a conventional pneumatic grinder, and an air intake control apparatus 41 of this kind of pneumatic grinders is installed at a position of a handle 42 proximate to a grinding head 43, such that when a user holds the handle 42 for a grinding job, the user presses onto a press board 411 of the intake control apparatus 41 by the center of a palm, and an end of the press board 411 is pivotally connected to a top surface of the handle 42 and at a position proximate to the grinding head 43, and another end of the press board 411 is lifted towards a rear end of the handle 42, wherein the bottom of a middle section of the press board 411 presses downward onto a rod 412, so that when the user presses the press board 411 by a palm, the rod 412 is pressed downward by the press board 411 at the same time to drive a valve rod 413 of the air intake control apparatus 41 to circulate air, so as to drive a pneumatic motor 44 at the position of the grinding head 43.

However, the conventional way of holding the grinder is very inconvenient and not favorable for a user's grip, because the user's wrist and lower arm are driven to move while the user's palm is pressing onto the press board 411, and thus the prior art takes much efforts and causes the grinding head 43 to shake easily. As a result, errors may be produced in the grinding job. Pressing the press board 411 by a palm also causes an inconvenient grip, so that when the pneumatic motor is operated and vibrated, the grip may be loosened easily.

Therefore, the technique of designing the press board of the air intake control apparatus 41 at the top of the handle 42 as described above requires feasible solutions and improvements.

In other words, if users can operate the tool by fingers, then the requirement for the controlling the operation can be met, since fingers are the most skillful part of a human hand.

If the original design of using a palm to press onto the press board of the aforementioned conventional grinder is replaced by a design of using fingers for the operation of the grinder, the shortcomings of the conventional grinder can be overcome. To let the press board be pressed and operated directly by fingers when a user holds the handle by a hand, it is necessary to redesign and install the press board at the bottom of the handle, but such arrangement will change the positions of many related components of the air intake control apparatus. It is noteworthy to point out that the space at the bottom of the handle of the grinder and proximate to the grinding head is narrower than the space at the top of the handle and proximate to the grinding head, so that when the press board is redesigned and installed at the bottom of the handle and proximate to the grinding head, the press board will move much further to the rear side of the handle than its original position at the top of the handle. Since the air intake control apparatus comes with a speed adjusting knob, therefore it is necessary to redesign a rotating portion of the speed adjusting knob at the top of the handle when the press board is designed at the bottom of the handle. Furthermore, the original way of using an end of the press board for a pivotal connection and pressing makes the position of the speed adjusting knob closer to the middle section of the handle, such that when a user holds the handle by a hand, the user will feel a sudden obstacle, and find it uneasy or uncomfortable to hold the handle.

Although the press board of the conventional grinder can be redesigned at the bottom of the handle, such that users can press and operate the press board directly by fingers, yet the grinder with an adjusted position of the press board still has an existing problem that users find it uneasy to hold the handle due to the position of the speed adjusting knob.

SUMMARY OF THE INVENTION

Therefore, it is a primary objective of the present invention to overcome the foregoing shortcomings of the prior art by providing a pneumatic grinder with an improved air intake control apparatus, wherein a press board of the air intake control apparatus of the grinder is designed at the bottom of a handle of the grinder and disposed at a position proximate to the grinding head, such that when a user holds the handle, the user can turn and press onto a force applying end of the press board upward by fingers, and uses a first lever-and-fulcrum method to drive a pulling end of the press board to pull a pull rod of the air intake control apparatus, and the pull rod is pulled to drive the valve rod, so as to allow air to circulate and drive a pneumatic motor.

Another objective of the present invention is to design a press board of an air intake control apparatus by means of a lever pivotal method, so that the position of a speed adjusting knob of the air intake control apparatus at the top of the handle is closer to the grinding head, and when the speed adjusting knob is designed at the top of the handle and proximate to the holding position, the problem of an uneasy or uncomfortable grip can be solved.

To achieve the foregoing objectives, the air intake control apparatus of the present invention comprises:

a grinding head, having a casing, and the casing having a chamber, and the chamber installing a pneumatic motor therein, and the pneumatic motor being connected to a grinding disc at an external end of a motor axle of the pneumatic motor, and the grinding disc being situated at an opening position of a bottom of the chamber of the casing;

a handle, coupled to the grinding head, and extended transversally outward from a lateral side of the casing, and the handle having an air intake passage disposed transversally therein, and the air intake passage being composed of a large-diameter passage and a small-diameter passage, and an end of the small-diameter passage being interconnected to the chamber, and another end of the small-diameter passage being interconnected to an end of the large-diameter passage, and another end of the large-diameter passage being interconnected to the outside, and the handle having an exhaust passage disposed below the air intake passage, and an end of the exhaust passage being interconnected to the outside, and another end of the exhaust passage being interconnected to the chamber, and the handle having a through hole longitudinally penetrating the handle, and the through hole also penetrating the small-diameter passage of the air intake passage; and an air intake control apparatus, including a speed adjusting knob, a pull rod, a press board, a washer, a valve, a valve rod, a spring and a hollow pipe.

The speed adjusting knob is comprised of a rod and a rotating portion, and the rod penetrates through the through hole and passes through the small-diameter passage and protrudes out from the bottom of the handle, and the rotating portion is disposed at the top of the rod for rotating the rod to adjust speed, and the rod has an accommodating space extended axially inward from the bottom of the rod and disposed at the position of the small-diameter passage, and an airflow guide hole corresponding to a distal opening of the large-diameter passage.

The pull rod is passed from the bottom of a rod of the speed adjusting knob rod and disposed in the accommodating space, and the pull rod has a transversal opening disposed proximate to the top of the pull rod and penetrates through both sides of the pull rod, and the bottom of the pull rod is protruded downward and out from the bottom of the rod.

The press board is disposed at the bottom of the handle, and forms a pulling end on the press board and proximate to an end of the grinding head, and the pulling end is connected to the bottom of the pull rod, and another end of the press board forms a force applying end and has a protrusion disposed on the top of the press board between the pulling end and the force applying end, and the protrusion is pivotally coupled to the bottom of the handle.

The washer is installed in the large-diameter passage, and a lateral side of the washer is pressed and connected to walls of a radial hole of the large-diameter passage and at a distal opening proximate to the small-diameter passage, and another lateral side of the washer is pressed and connected to a lateral side of the valve, and another lateral side of the valve is pressed by an end of the spring, and another end of the spring is pressed by an end of a hollow pipe in the large-diameter passage, and an end of the valve rod passes through the center of the valve, and the valve rod passes from the large-diameter passage through a penetrating hole at the center of the washer into the small-diameter passage, and another end of the valve rod is situated in an airflow guide hole of the rod and passed through a transversal through hole of the pull rod.

DETAILED DESCRIPTION OF THE PREFERRED EMBODIMENTS

Referring to FIGS. 1 to 5 for a structure of a pneumatic grinder of the present invention according to a preferred embodiment of the present invention, the preferred embodiment is provided for the purpose of illustrating the invention only, but not intended for limiting the invention.

Figure 1:
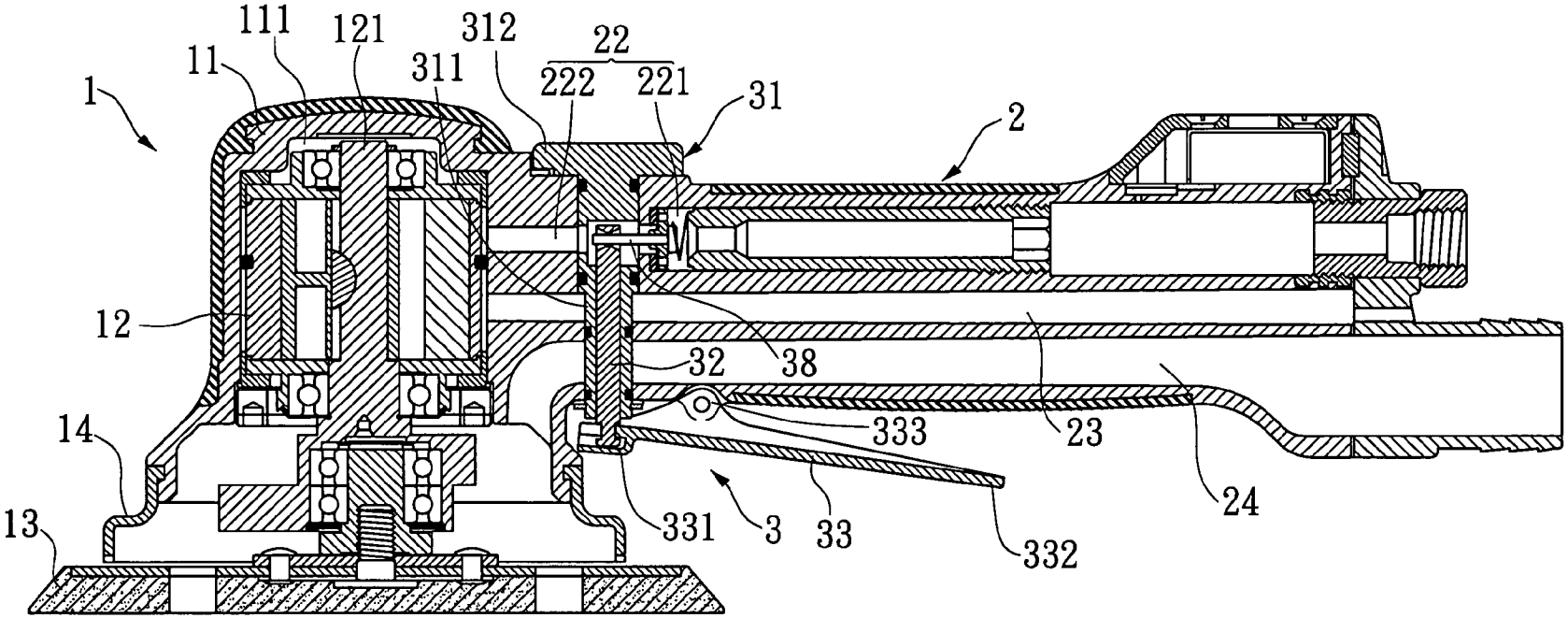
FIG. 1 is a section view of a pneumatic grinder in accordance with the present invention.
Figure 2:
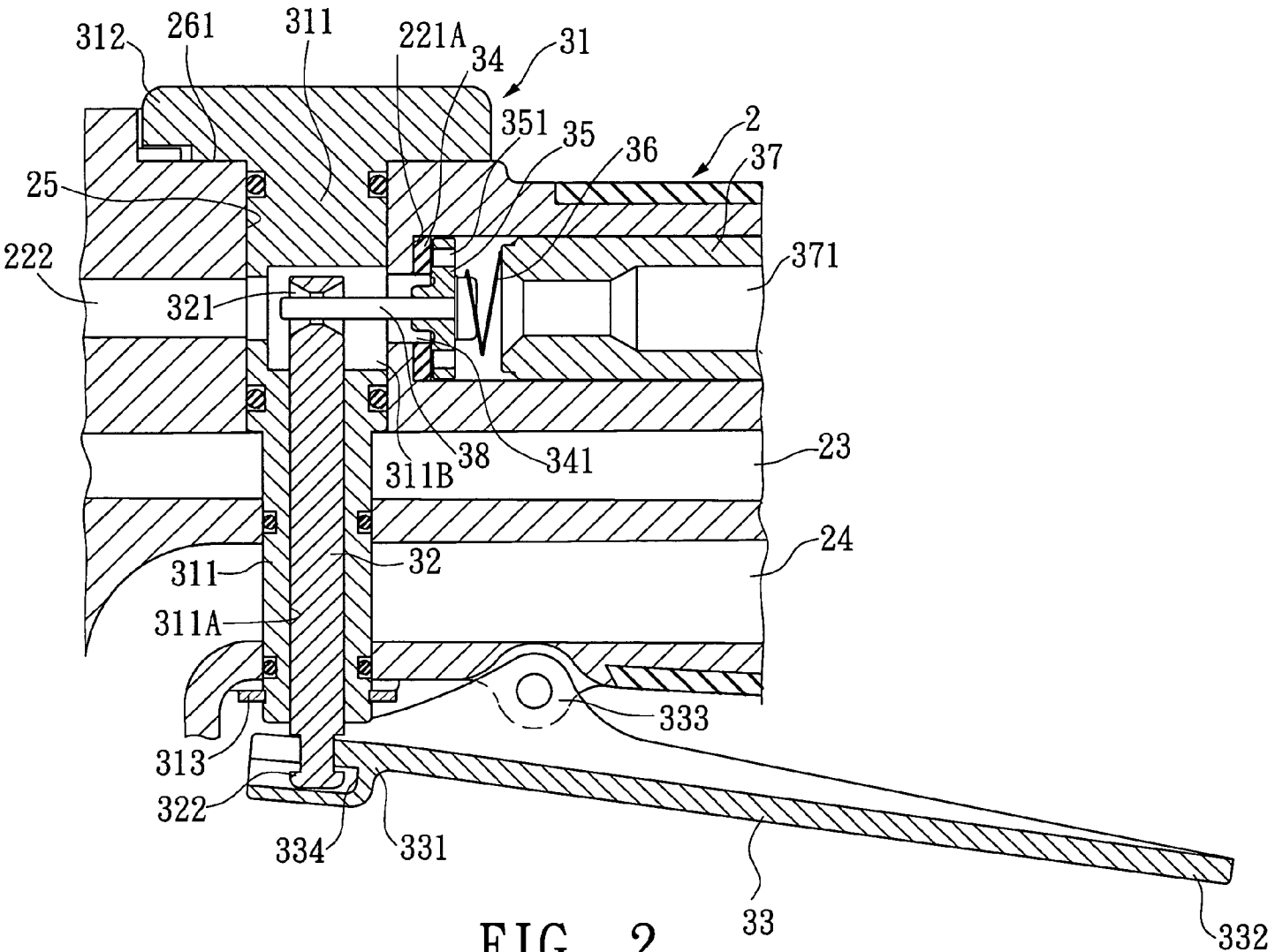
FIG. 2 is an enlarged view of the air intake control apparatus as depicted in FIG. 1.

In FIGS. 1 and 2, the pneumatic grinder of the invention comprises:

a grinding head 1, having a casing 11, and the casing 11 has a chamber 111, and the chamber 111 installs a pneumatic motor 12 therein, and the pneumatic motor 12 is connected to a grinding disc 13 at an external end of a motor axle 121 of the pneumatic motor 12, and the grinding disc 13 is situated at an opening position of a bottom of the chamber 111 of the casing 11, wherein the casing 11 further includes a dust cover 14 disposed at the bottom of the casing 11 and situated around the top of the grinding disc 13;

a handle 2, coupled to the grinding head 1, and extended transversally outward from a lateral side of the casing 11, and the handle 1 has an air intake passage 22 disposed transversally therein, and the air intake passage being 22 is composed of a large-diameter passage 221 and a small-diameter passage 222, and an end of the small-diameter passage 222 is interconnected to the chamber 111, and another end of the small-diameter passage 222 is interconnected to an end of the large-diameter passage 221, and another end of the large-diameter passage 221 is interconnected to the outside, and the handle 2 has an exhaust passage 23 disposed below the air intake passage 23, and an end of the exhaust passage 23 is interconnected to the outside, and another end of the exhaust passage 23 is interconnected to the chamber 111, and the handle 2 contains a dust extracting passage 24 disposed below the exhaust passage 23, and an end of the dust extracting passage 24 is interconnected to the outside, and another end of the dust extracting passage 24 is interconnected to the top of the grinding disc 13, and the handle 2 has a through hole 25 longitudinally penetrating the handle 2, and the through hole 25 also penetrates the small-diameter passage 222 of the air intake passage 22; and an air intake control apparatus 3, including a speed adjusting knob 31, a pull rod 32, a press board 33, a washer 34, a valve 35, a spring 36, a hollow pipe 37 and a valve rod 38.

The speed adjusting knob 31 is comprised of a rod 311 and a rotating portion 312, and the rod 311 penetrates the through hole 25, and passes through the small-diameter passage 222 and protrudes out from the bottom of the handle 2, and the rotating portion 312 is disposed at the top of the rod 311 for rotating the rod 311 to adjust a speed, and the rod 311 having an accommodating space 311A extended axially inward from the bottom of the rod 311 and disposed at the position of the small-diameter passage, and an airflow guide hole 311B corresponding to a distal opening of the large-diameter passage, and the rod 311 of the speed adjusting knob 31 is latched and fixed to the handle 2 by a latch 313.

In this embodiment, a pressing surface 261 is formed around the periphery of a through hole 25 around the top of the handle 2, and the bottom of the rotating portion 312 of the speed adjusting knob 31 is pressed and connected to the pressing surface 261 for positioning the rotating portion 312.

The pull rod 32 is passed from the bottom of a rod 311 of the speed adjusting knob rod 31 and disposed in the accommodating space 311A, and has a transversal opening 321 disposed proximate to the top of the pull rod 32 and penetrates through both sides of the pull rod 32, and the bottom of the pull rod 32 is protruded downward and out from the bottom of the rod 311.

The press board 33 is disposed at the bottom of the handle 2, and forms a pulling end 331 on the press board 33 and proximate to an end of the grinding head 1, and the pulling end 331 is connected to the bottom of the pull rod 32, and another end of the press board 33 forms a force applying end 332, and has a protrusion 333 disposed on the top of the press board 33 between the pulling end 331 and the force applying end 332, and the protrusion 333 is pivotally coupled to the bottom of the handle 2.

The vertical distance from the force applying end 332 to the bottom of the handle 2 is greater than a vertical distance from the pulling end 331 to the handle 2, and the length from the protrusion 333 to the force applying end 332 is greater than the length from the protrusion 333 to the pulling end 331, so that the press board 33 is tilted with respect to the bottom of the handle 2, and users can apply a force onto the force applying end 332 easily.

In this embodiment, the bottom of the pull rod 32 further includes a protrusion 322, and the pulling end 331 of the press board 33 has a pulling portion 334 latched to the protrusion 332 at the bottom of the pull rod 32 and provided for users to pull the pull rod 32 by the pulling end 331 of the press board 33.

The washer 34 is installed in the large-diameter passage 221 of the air intake passage 22, and a lateral side of the washer 34 is pressed and connected to walls 221A of a radial hole of the large-diameter passage 221 and at a distal opening proximate to the small-diameter passage 222, and another lateral side of the washer 34 is pressed and connected to a lateral side of the valve, and another lateral side of the valve 35 is pressed by an end of the spring 36, and another end of the spring 36 is pressed by an end of a hollow pipe 37 in the large-diameter passage 221, and the hollow pipe 37 has a hollow passage 371 penetrating both ends, and the hollow passage 371 is interconnected with the large-diameter passage 221 of the air intake passage 22, and an end of the valve rod 38 is passed and fixed at the center of the valve 35, and the valve rod 38 is passed from the large-diameter passage 221 through a penetrating hole 34 at the center of the washer 34 to the small-diameter passage 222, and another end of the valve rod 38 is situated in the airflow guide hole 311 of the rod 311 and passed into a transversal through hole 321 of the pull rod 32.

Therefore, the force applying end 332 of the press board 33 is turned upward, such that when the pulling end 331 of the press board 33 pulls the pull rod 32, the pull rod 32 is shifted downward to drive the valve rod 38 into a slanting position, and a plurality of ventilation holes 351 on the valve 35 are interconnected with and the penetrating hole 341 of the washer 34, so as to circulate air into the chamber 111 to drive the pneumatic motor 12.

Figure 3:
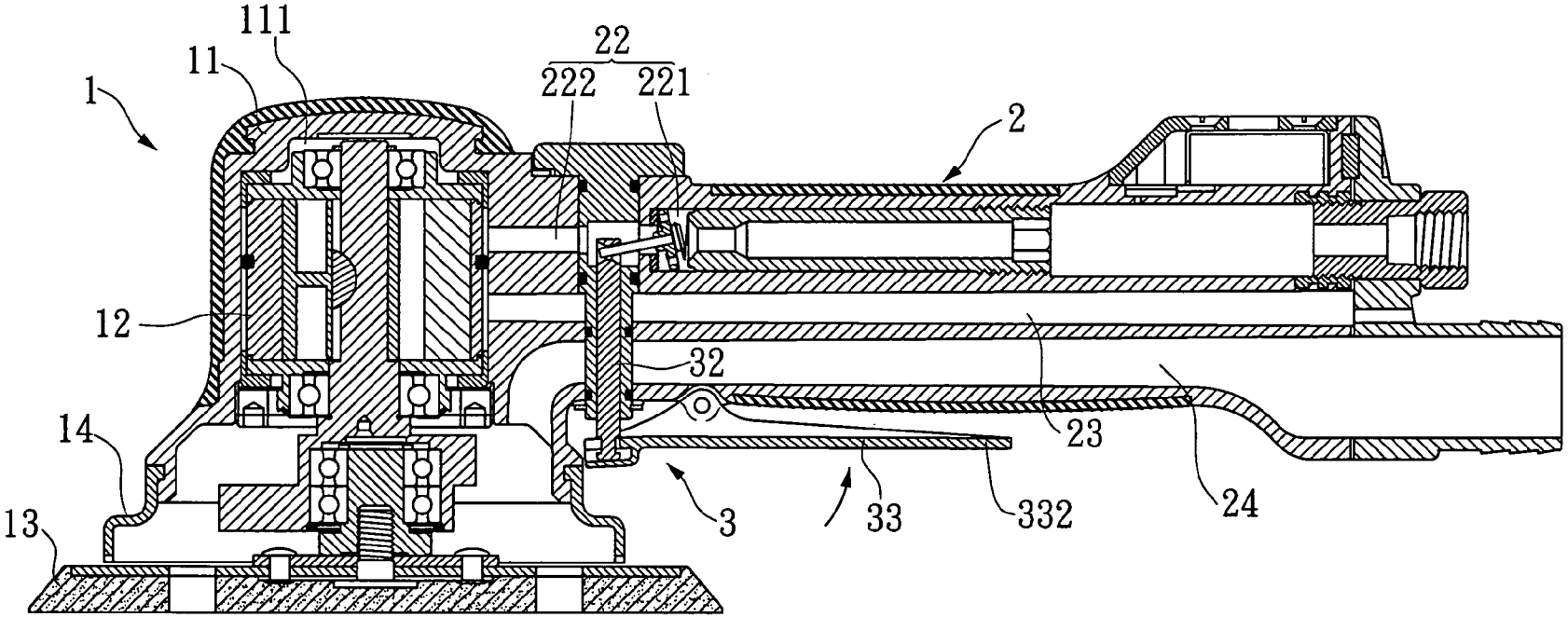
FIG. 3 is a section view of a pneumatic grinder with a press board being turned and pressed in accordance with the present invention.
Figure 4:
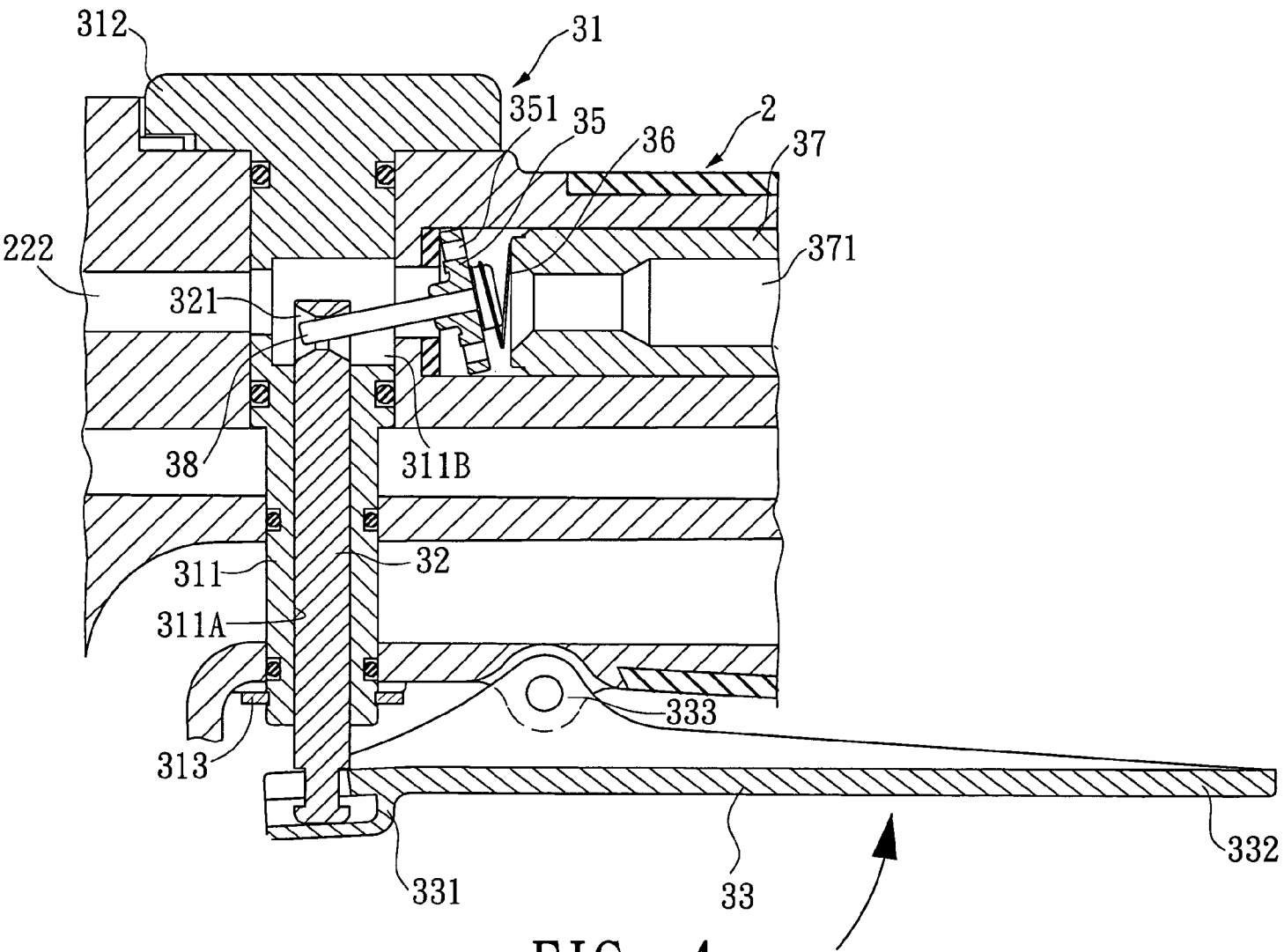
FIG. 4 is an enlarged view of the air intake control apparatus as depicted in FIG. 3, wherein a press board is turned and pressed, and the press board pulls a pull rod down to drive a valve rod to move downward, and the valve rod drives the valve to shift into a conduction state.
Figure 5:
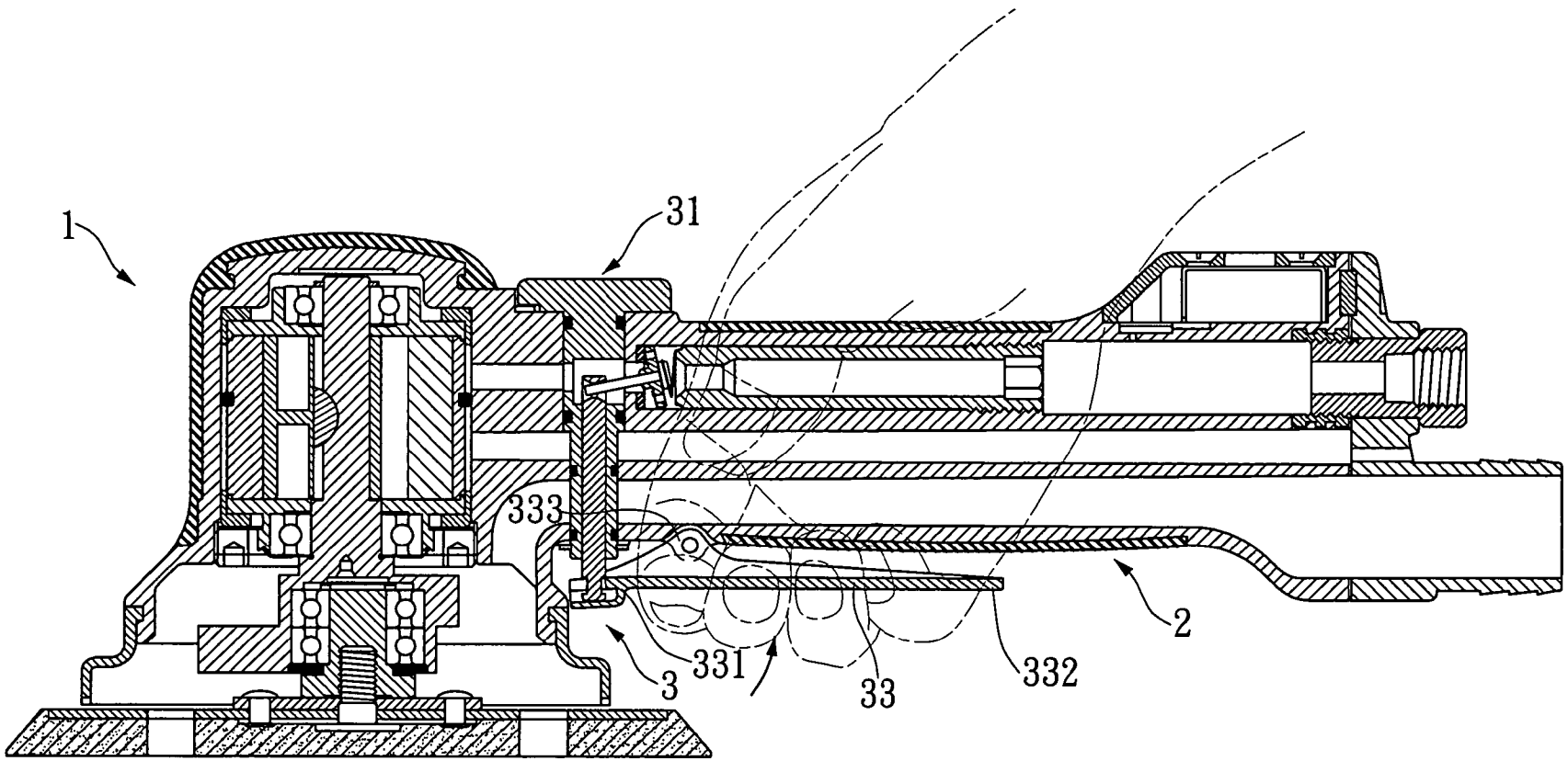
FIG. 5 is a schematic view of the handle held by a hand as depicted in FIG. 3, wherein the press board is turned and pressed upward by fingers.
Figure 6:
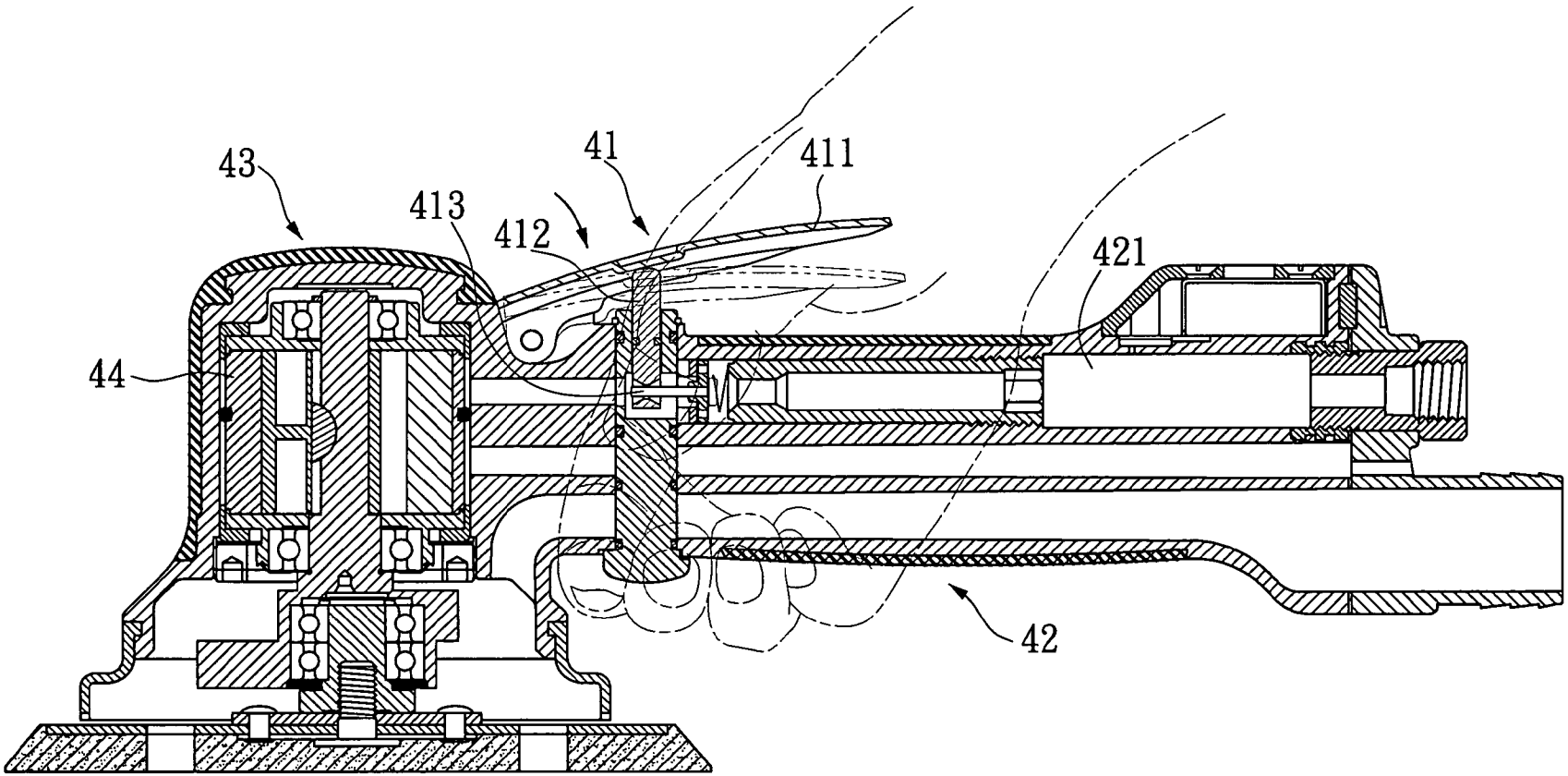
FIG. 6 PRIOR ART
FIG. 6 is a schematic view of a prior art pneumatic grinder wherein a press board is disposed at the top of a handle, and the press board is pressed downward to a rod.

Referring to FIGS. 3 to 5, a user holds the handle 2 from the top towards the bottom by a hand, and turns and presses the press board 33 with respect to the bottom of the handle 2 by fingers. The force applying end 332 of the press board 33 is turned upward by fingers, so that the press board 33 is pivoted with respect to the handle 2 by the protrusion 333. Now, the pulling end 331 of the press board 33 uses the protrusion 333 as a fulcrum for the pivotal turning by the lever principle to move downward. Therefore, the pulling end 331 pulls the pull rod 32 to move downward to drive the pneumatic motor 12 as described above.

In summation of the description above, the press board of the air intake control apparatus is installed at the bottom of the handle and proximate to the grinding head in accordance with the present invention, and a first lever-and-fulcrum principle is used, such that when a user holds the handle, the user can turn and press the force applying end of the press board by fingers flexibly and easily, and the position of the rotating portion of the speed adjusting knob of the air intake control apparatus at the top of handle can be closer to the grinding head, so as to avoid an uneasy and uncomfortable grip.

What is claimed is:

1. A pneumatic grinder with an improved air intake control apparatus, comprising:

a grinding head, having a casing, and the casing having a chamber, and the chamber installing a pneumatic motor therein, and the pneumatic motor being connected to a grinding disc at an external end of a motor axle of the pneumatic motor, and the grinding disc being situated at an opening position of a bottom of the chamber of the casing;

a handle, coupled to the grinding head, and extended transversally outward from a lateral side of the casing, and the handle having an air intake passage disposed transversally therein, and the air intake passage being composed of a large-diameter passage and a small-diameter passage, and an end of the small-diameter passage being interconnected to the chamber, and another end of the small-diameter passage being interconnected to an end of the large-diameter passage, and another end of the large-diameter passage being interconnected to the outside, and the handle having an exhaust passage disposed below the air intake passage, and an end of the exhaust passage being interconnected to the outside, and another end of the exhaust passage being interconnected to the chamber, and the handle having a through hole longitudinally penetrating the handle, and the through hole also penetrating the small-diameter passage of the air intake passage; and an air intake control apparatus, including a speed adjusting knob, a pull rod, a press board, a washer, a valve, a valve rod, a spring and a hollow pipe, wherein: the speed adjusting knob is comprised of a rod and a rotating portion, and the rod penetrates the through hole, and passes through the small-diameter passage and protrudes out from the bottom of the handle, and the rotating portion is disposed at the top of the rod for rotating the rod to adjust a speed, and the rod having an accommodating space extended axially inward from the bottom of the rod and disposed at the position of the small-diameter passage, and an airflow guide hole corresponding to a distal opening of the large-diameter passage;

the pull rod is passed from the bottom of a rod of the speed adjusting knob rod and disposed in the accommodating space, and has a transversal opening disposed proximate to the top of the pull rod and penetrates through both sides of the pull rod, and the bottom of the pull rod is protruded downward and out from the bottom of the rod;

the press board is disposed at the bottom of the handle, and forms a pulling end on the press board and proximate to an end of the grinding head, and the pulling end is connected to the bottom of the pull rod, and another end of the press board forms a force applying end, and has a protrusion disposed on the top of the press board between the pulling end and the force applying end, and the protrusion is pivotally coupled to the bottom of the handle; and the washer is installed in the large-diameter passage, and a lateral side of the washer is pressed and connected to walls of a radial hole of the large-diameter passage and at a distal opening proximate to the small-diameter passage, and another lateral side of the washer is pressed and connected to a lateral side of the valve, and another lateral side of the valve is pressed by an end of the spring, and another end of the spring is pressed by an end of a hollow pipe in the large-diameter passage, and an end of the valve rod passes through the center of the valve, and the valve rod passes from the large-diameter passage through a penetrating hole at the center of the washer into the small-diameter passage, and another end of the valve rod is situated in an airflow guide hole of the rod and passed through a transversal through hole of the pull rod.

2. The pneumatic grinder with an improved air intake control apparatus as recited in claim 1, wherein the casing further includes a dust cover disposed at the bottom of the casing and situated around the top of the grinding disc.

3. The pneumatic grinder with an improved air intake control apparatus as recited in claim 1, wherein the transversal opening is tapered and interconnected at the position penetrating both sides of the pull rod and towards an axial center of the pull rod.

4. The pneumatic grinder with an improved air intake control apparatus as recited in claim 1, wherein the pull rod further includes a protrusion disposed at the bottom of the pull rod, and a pulling end of the press board has a pulling portion latched to the protrusion at the bottom of the pull rod.

5. The pneumatic grinder with an improved air intake control apparatus as recited in claim 1, wherein a vertical distance from the force applying end to the bottom of the handle is greater than a vertical distance from the pulling end to the handle, and the length from the protrusion to the force applying end is greater than the length from the protrusion to the pulling end.

6. The pneumatic grinder with an improved air intake control apparatus as recited in claim 1, wherein the hollow pipe has a hollow passage interconnected to the large-diameter passage of the air intake passage.

7. The pneumatic grinder with an improved air intake control apparatus as recited in claim 1, wherein the handle includes a dust extracting passage disposed below the exhaust passage, and an end of the dust extracting passage is interconnected to the outside, and another end of the dust extracting passage is interconnected to the top position of the grinding disc.

8. The pneumatic grinder with an improved air intake control apparatus as recited in claim 1, wherein the speed adjusting knob includes a rod latched and fixed to the handle by a latch.

9. The pneumatic grinder with an improved air intake control apparatus as recited in claim 1, wherein the handle forms a pressing surface at the top of through hole around an external periphery of handle, and a bottom surface of a rotating portion of the speed adjusting knob presses and connects to the pressing surface for positioning the rotating portion.

* * * * *